US007100334B2

(12) United States Patent
Milios et al.

(10) Patent No.: US 7,100,334 B2
(45) Date of Patent: Sep. 5, 2006

(54) CONVEYOR FOR CONVEYING PEOPLE

(76) Inventors: Ioannis Milios, 140 Franklin St. #6A, New York, NY (US) 10013; Dimitrios Korres, Varnali 9, Melissia, Athens, 15127 (GR)

( * ) Notice: Subject to any disclaimer, the term of this patent is extended or adjusted under 35 U.S.C. 154(b) by 292 days.

(21) Appl. No.: 10/250,003

(22) Filed: May 27, 2003

(65) Prior Publication Data

US 2004/0237427 A1 Dec. 2, 2004

(51) Int. Cl.
*E04F 11/00* (2006.01)

(52) U.S. Cl. ..... 52/183; 198/324; 198/333

(58) Field of Classification Search ..... 198/333, 198/324, 332, 321; 52/177, 179, 182, 183
See application file for complete search history.

(56) References Cited

U.S. PATENT DOCUMENTS

| | | | | |
|---|---|---|---|---|
| 3,964,596 | A | | 6/1976 | Heusler |
| 4,244,457 | A | | 1/1981 | Ernst |
| 4,335,805 | A | | 6/1982 | Grass |
| 4,557,369 | A | | 12/1985 | Ishida |
| 4,635,783 | A | | 1/1987 | Hofling |
| 4,681,207 | A | | 7/1987 | Goto |
| 4,682,681 | A | | 7/1987 | Teranishi |
| 5,062,519 | A | * | 11/1991 | Haruta ..... 198/333 |
| 5,217,089 | A | | 6/1993 | Virk |
| 5,332,077 | A | * | 7/1994 | Ogimura ..... 198/333 |
| 5,435,428 | A | * | 7/1995 | Adachi et al. ..... 198/324 |
| 5,890,330 | A | | 4/1999 | Lesage |
| 6,115,975 | A | | 9/2000 | Abdollahi |
| 6,318,033 | B1 | | 11/2001 | Birch |
| 2002/0189177 | A1 | | 12/2002 | Eve |

* cited by examiner

*Primary Examiner*—Carl D. Friedman
*Assistant Examiner*—Yvonne M. Horton
(74) *Attorney, Agent, or Firm*—Oppedahl & Olson LLP

(57) ABSTRACT

A conveyor specialized to convey people, and more particularly a conveyor which may serve as a conventional staircase, comprises treads that can individually raise and lower by the amount of the tread rise. To ascend, a user stands on the lowest level, and the tread lifts to match the height of the next tread. The user steps forward to the next tread. That tread likewise lifts to match the height of the next tread, and so on. In this way the user is able to ascend the height of the staircase without having to step up. A corresponding process permits descending the height of the staircase without having to step down. The conveyor can work even if the staircase winds or curves or goes around corners. Optionally a platform is caused to move laterally from each step to the next, so that the user need not even step forward during the process.

15 Claims, 6 Drawing Sheets

CONVEYOR FOR CONVEYING PEOPLE

BACKGROUND OF INVENTION

The invention relates to a conveyor specialized to convey people, and relates more particularly to a conveyor which may serve as a conventional staircase.

Before discussing the invention in detail it may be helpful to define certain terms.

Turning first to FIG. 1, what may be seen is a staircase 48, defined as a flight of stairs with its supporting framing and balustrade 41. Balusters 40 are shown, which are closely spaced vertical supports for railing 43. The railing 43 with supporting balusters 40 are referred to collectively as a balustrade 41. A fitting is a general term for a short transition piece in a handrail where there is a quick change in the direction of the handrail. A gooseneck 42 is a specific type of fitting designed to transition a stair handrail 43 to a horizontal guardrail 49.

It will be appreciated that balustrades are used not only on staircases but also on balconies. Thus a guardrail may be defined which is the top member of a balustrade system designed to keep people from falling off of an open balcony or staircase.

It will also be appreciated that some staircases are not "open," that is, some staircases have a wall to one side or both. On a side that is not "open" there is usually provided a handrail, defined as a long narrow band of wood or metal following the slope of a staircase placed at a height where a person can hold it for stability while climbing the staircase. It will be appreciate that sometimes a handrail may also act as a guardrail.

Turning to FIG. 2, treads 45 may be seen, each of which is defined as the upper surface of a step in a stair. The staircase may include risers 44, each of which is a vertical board spanning the space between treads on a staircase. Not all staircases have risers.

For a particular staircase there is a tread rise 46 defined as the vertical measurement from the top of one tread to the top of the next tread in line. Likewise there is a tread run 47 defined as the horizontal distance measured from the front of one tread to the front of the next tread above or below it. The slope of a staircase is defined as the measure of the angle formed by the relationship of rise to run on a staircase. The vast majority of staircases are designed so that the tread run is constant across all of the stairs of the staircase, and so that the tread rise is constant across all of the stairs of the staircase.

It will be appreciated that in some staircases, each tread 55 has a "nose" 51 as shown in FIG. 4. With such treads the tread run 47 is defined as shown, measured from the front of one tread to the front of the next tread above or below it.

Some staircases are built with one or more "stair jacks" or "stringers" 50 (FIG. 3) to which treads and risers are attached.

skilled in the art are also familiar with such terms as a "curved staircase," defined as a staircase which changes direction using a circular pattern with an inside radius less than twice the width of the individual treads; a "spiral staircase," defined as a staircase whose treads radiate from one central supporting post or newel; and a "winding staircase," defined as any staircase which changes direction while walking on individual treads which are tapered along their run. A "newel" or "newel post" can be a post giving additional structural support to a balustrade, or can be the central supporting post of a spiral staircase.

Much attention has been paid in recent years to the problem that some people find it difficult to ascend and descend staircases. Where a building (such as a residence or a commercial building) is being constructed, it is a straightforward matter to plan ahead and to provide escalators or elevators. An escalator is an endless loop of stairs which move upward or downward, with stairs returning to the other end of the escalator in a passageway beneath the staircase. An elevator, of course, requires an elevator shaft. An escalator requires setting aside a substantial volume for its return passageway, extending for some distance below the staircase. The escalator takes up a greater width than the width of the treads. Despite these requirements it is usually a straightforward matter, in the design of new construction, to provide any needed elevator shafts and any needed volumes for escalator return passageways and any needed widths.

It often turns out, however, that the need to accommodate a person who finds it difficult to ascend and descend staircases is perceived only after a building has been built. With such a building it is sometimes impossible, or at least prohibitively expensive, to add an elevator or escalator. In the case of a proposed elevator, it often develops that there is no suitable location for the placement of an elevator shaft. In the case of a proposed escalator which might replace a staircase, it often develops that there is no place to put the return passageway and that the width of an escalator is too great to fit in the width of the stairway that is to be replaced.

In a rented or leased space such as a residential apartment, or in a multitenant setting such as a cooperative or condominium apartment, there is a further difficulty in that even if cost is no object, and even if a location for an elevator or escalator can be found, it may be impossible to obtain permission from the landlord or condominium association to carry out the structural modifications that are required for installation of the elevator or escalator.

Faced with these concerns, the person desiring to accommodate (in an existing building) a person who finds it difficult to ascend and descend staircases often has only a few possible approaches, none of which is fully satisfactory. A typical approach is the installation of a chair and track mechanism. A track (or a set of tracks) is installed along one side of the stairway, and a mechanized chair is set up so that it may ascend and descend the track.

The tracked chair has numerous drawbacks. First, it takes away some of the otherwise usable width of the staircase. Even if every effort is made to minimize the lost width (e.g. if the chair seat can fold upwards for storage) the staircase will lose at least an inch or two of width.

Second, the track needs to be lubricated and the lubricated track is necessarily open (to some extent) so that there is the danger that clothing will be stained after coming into contact with the lubricant.

Third, it will often develop that if a person seeks to use the chair at one end (e.g. the top or bottom) of the staircase, this will happen at a time when the chair is at the other end of the staircase. This means that there must be a "call button" to call the chair to the would-be user, and the would-be user is forced to wait until the chair arrives.

Fourth, the chair track system may interfere with use of the hand rail on the side of the staircase where the track system is installed.

Fifth, not all staircases are well suited to chair track systems. A spiral or curved or winding staircase may rule out a track system due to the curves or the winding. Some two-part staircases go straight to a landing, and then proceed upwards at a different angle such as a right angle; such staircases sometimes rule out a chair track system.

Even a straight staircase may be unsuitable for a chair track system. For example if the staircase has balustrades and guard rails on both sides (i.e. neither side is a wall), it may turn out that there is insufficient structural strength in the balustrade to support the chair track system. Even if one side of the staircase has a wall, it may develop that the wall is unsuitable to support the chair track system, due to lack of sufficient structural strength or lack of suitable points of attachment.

It will also be appreciated that a chair track system may be used by at most one person at a time. This is a problem if one person wishes to ascend at the same time another person wishes to descend. It is also a problem if one person wishes to ascend a few moments after another person has already started to ascend. Finally, it is a problem if, say, two persons wish to ascend at the same time, since the chair does not have two seats.

Finally, and perhaps most importantly for many persons, a chair track system may be psychologically or emotionally or aesthetically undesirable. The chair track system is an extraordinarily prominent signal, incapable of being overlooked, that someone has difficulty ascending and descending stairs. This very signal may be uncomfortable for the persons residing in a home where it is proposed to install such a system. Many persons will find a chair track system to be aesthetically displeasing and may try to postpone or avoid its installation for that reason as well.

For all these reasons, it will be readily appreciated that there has been and is a long-felt need for a mechanism which would simultaneously fulfill several seemingly incompatible aims—a mechanism that is well-suited to helping people get from one level of a building to another, that is readily installed even in existing buildings, that can accommodate not only straight staircases but staircases which turn or go around corners, that is likely to be approved by a landlord or condominium association, that does not require structural modifications to the building, that does not take up otherwise usable width of a staircase, that will not make a person wait while it traverses the length of a staircase, and that is not visually intrusive.

SUMMARY OF INVENTION

A conveyor specialized to convey people, and more particularly a conveyor which may serve as a conventional staircase, comprises treads that can individually raise and lower by the amount of the tread rise. To ascend, a user stands on the lowest level, and the tread lifts to match the height of the next tread. The user steps forward to the next tread. That tread likewise lifts to match the height of the next tread, and so on. In this way the user is able to ascend the height of the staircase without having to step up. A corresponding process permits descending the height of the staircase without having to step down. The conveyor can work even if the staircase winds or curves or goes around corners. Optionally a platform is caused to move laterally from each step to the next, so that the user need not even step forward during the process.

BRIEF DESCRIPTION OF DRAWINGS

The invention is described with reference to a drawing in several figures.

DETAILED DESCRIPTION

Figure 1:
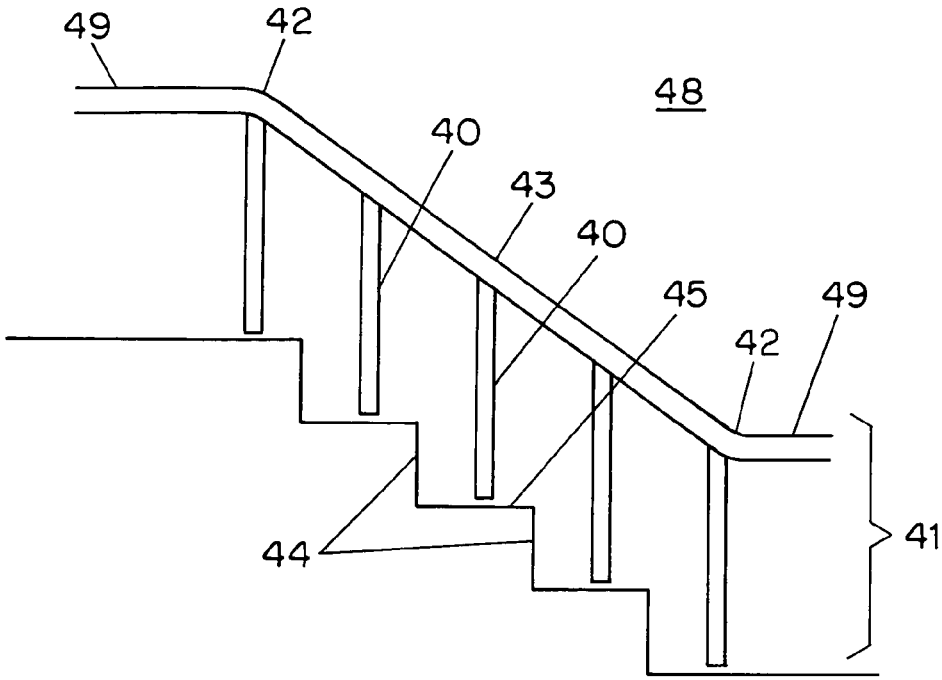
FIG. 1 PRIOR ART
FIG. 1 is a side view of a prior-art staircase.
Figure 2:
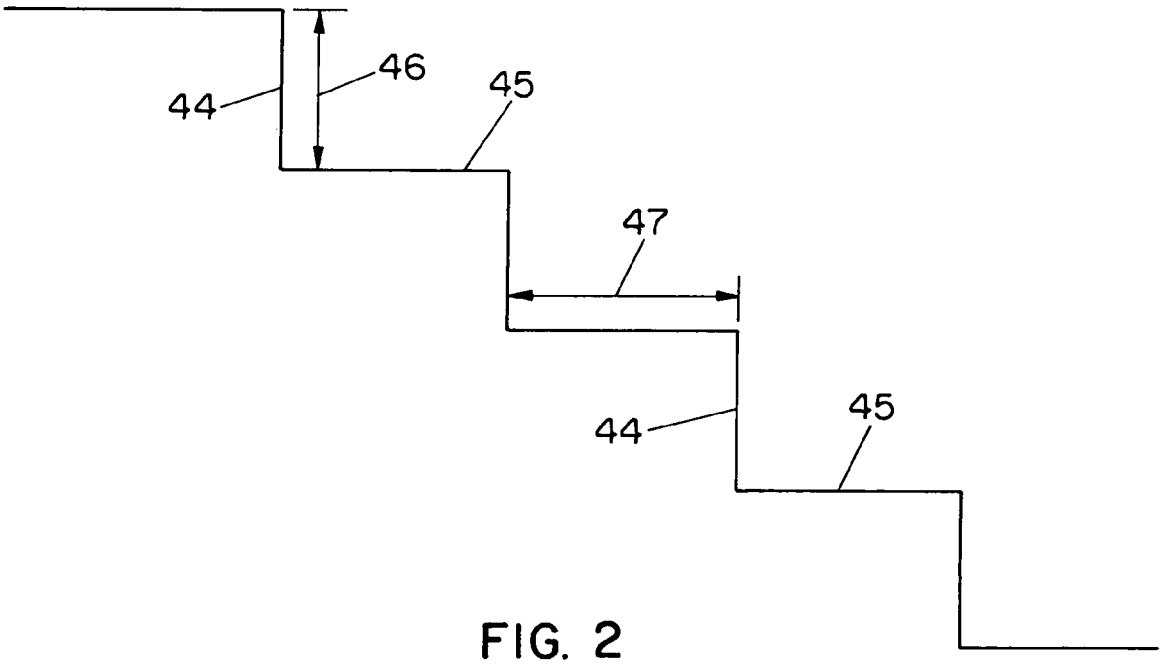
FIG. 2 PRIOR ART
FIG. 2 is a close-up view of the staircase of FIG. 1.
Figure 3:
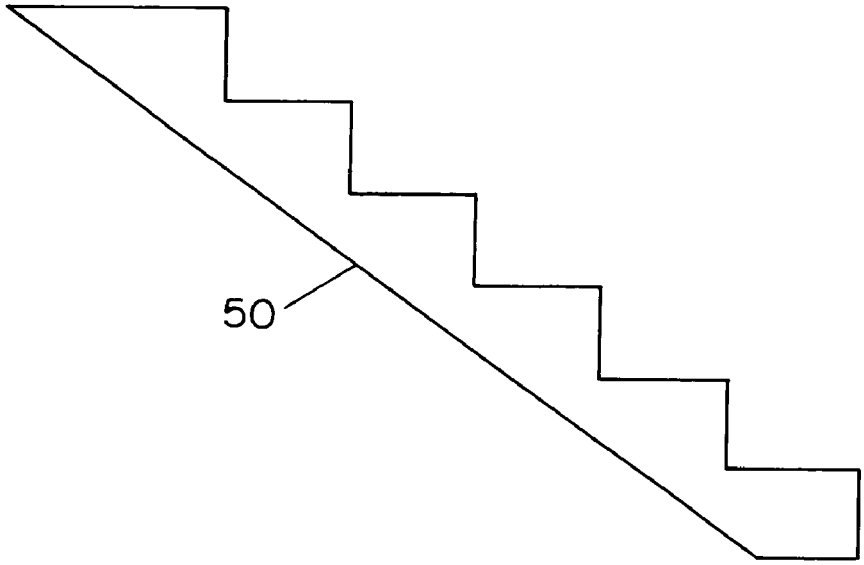
FIG. 3 PRIOR ART
FIG. 3 shows a staircase stringer.
Figure 4:
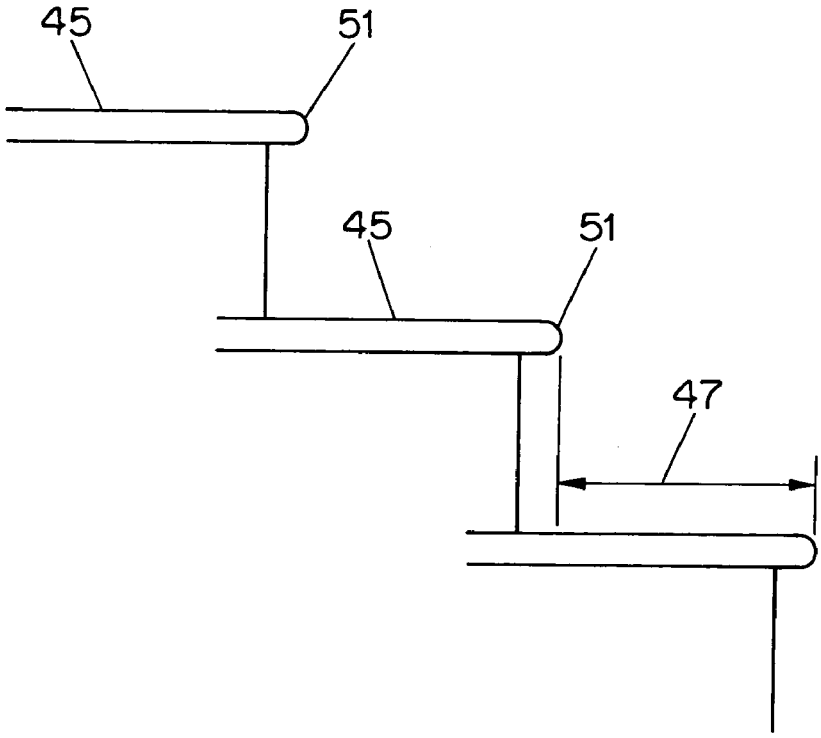
FIG. 4 PRIOR ART
FIG. 4 shows "noses" on stair treads.
Figure 5:
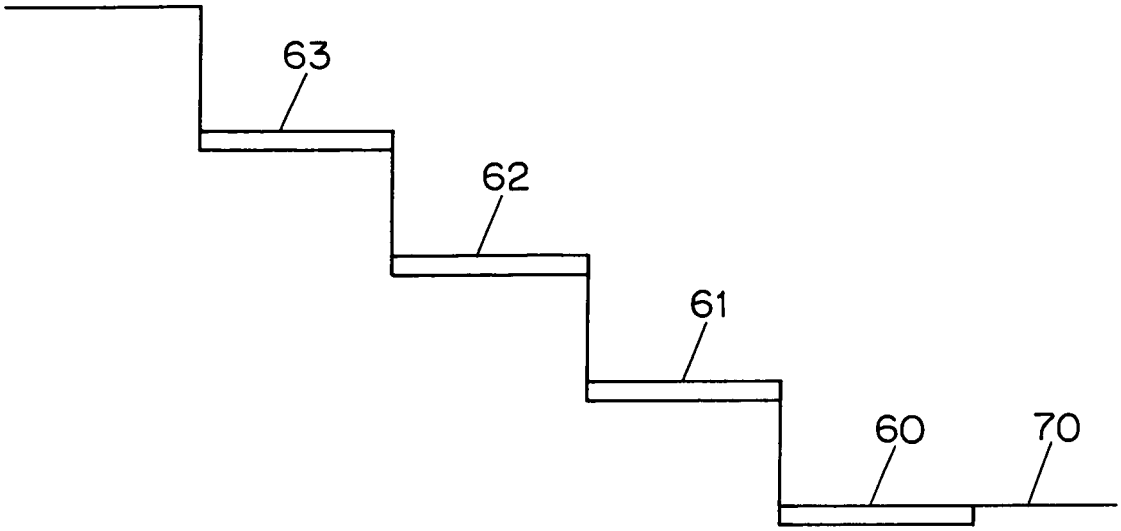
FIGS. 5–9 show a sequence of views for operation of the invention.

Turning first to FIG. 5, what is shown is a side view of a staircase according to an embodiment of the invention. Treads 60, 61, 62, and 63 may be seen. The view of FIG. 5 is "at rest," and the staircase of FIG. 5 may well be nearly visually indistinguishable from a prior-art staircase. This is an extremely desirable quality for the reasons described above relating to the visual impact of, for example, a chair track system.

Importantly, in the apparatus of FIG. 5, each tread 60, 61, 62 and 63 is capable of lifting by an amount sufficient to match the tread above it, that is, by a tread rise distance. The mechanism bringing about this lift is omitted for clarity in FIG. 5, and those skilled in the art will have no difficulty selecting from among many suitable mechanisms, among them hydraulic cylinders and scissors jacks. In an unenergized state, the mechanisms are at a "rest" position as shown and the staircase is usable as a conventional staircase.

A would-be user of the staircase who wishes to ascend the staircase may simply walk up the steps as in the prior art, or may take advantage of the lifting mechanism as will now be described. The use of the lifting mechanism starts with the user stepping onto the tread 60.

Figure 6:
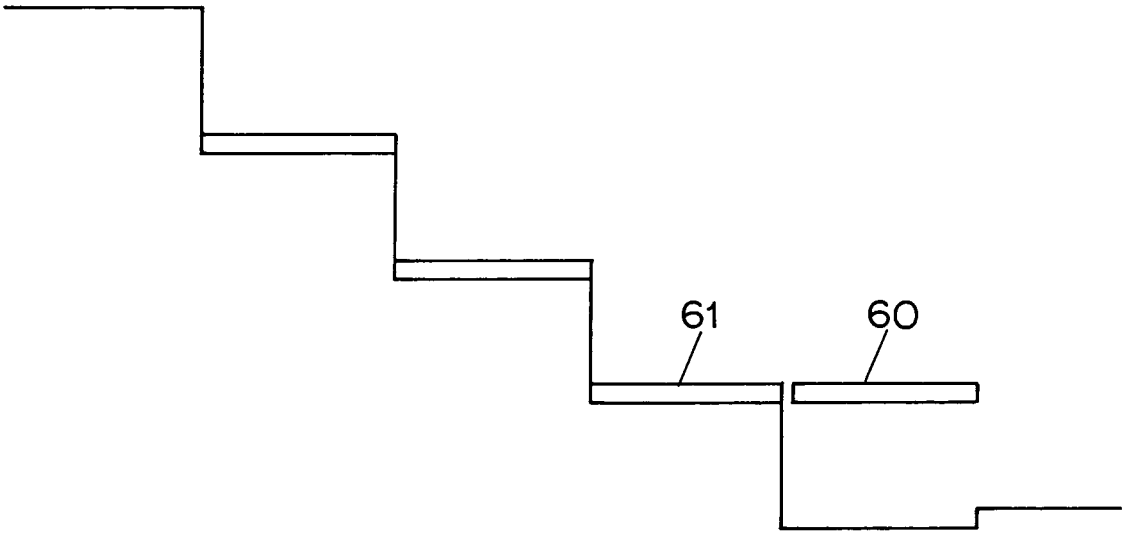

Turning now to FIG. 6, it may be seen that the tread 60 has been lifted by the tread rise distance, lifting the user with it. The user may then conveniently step forward onto tread 61.

Figure 7:
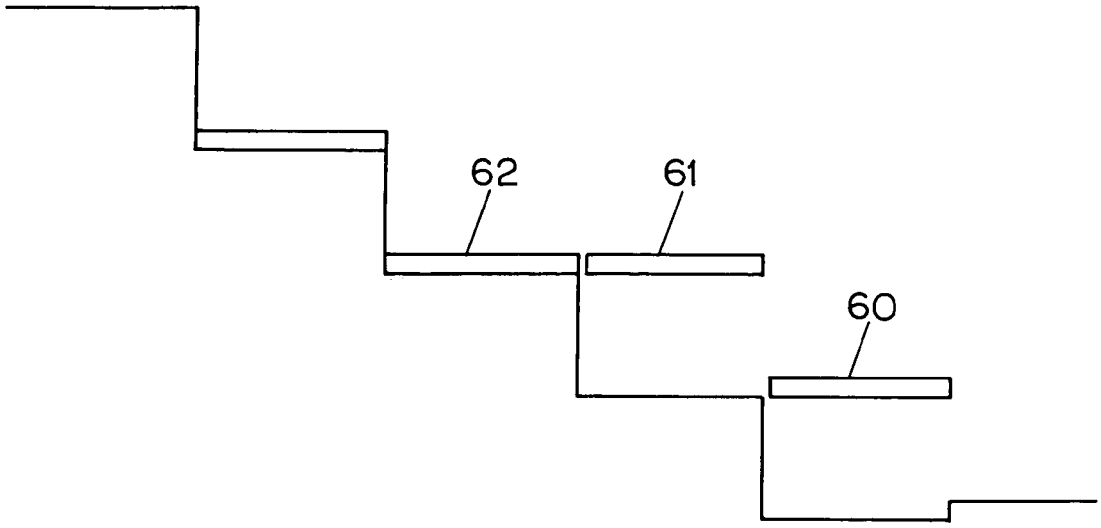

Turning now to FIG. 7, it may be seen that the tread 61 has been lifted by the tread rise distance, lifting the user with it. The user may then conveniently step forward onto tread 62.

At the time depicted in FIG. 7 it is interesting to discuss what happens with tread 60. In a simple case, tread 60 remains at its upper position, so that if the user falls backwards, the harm to the user is no greater than if the fall had occurred on a prior-art staircase.

Figure 8:
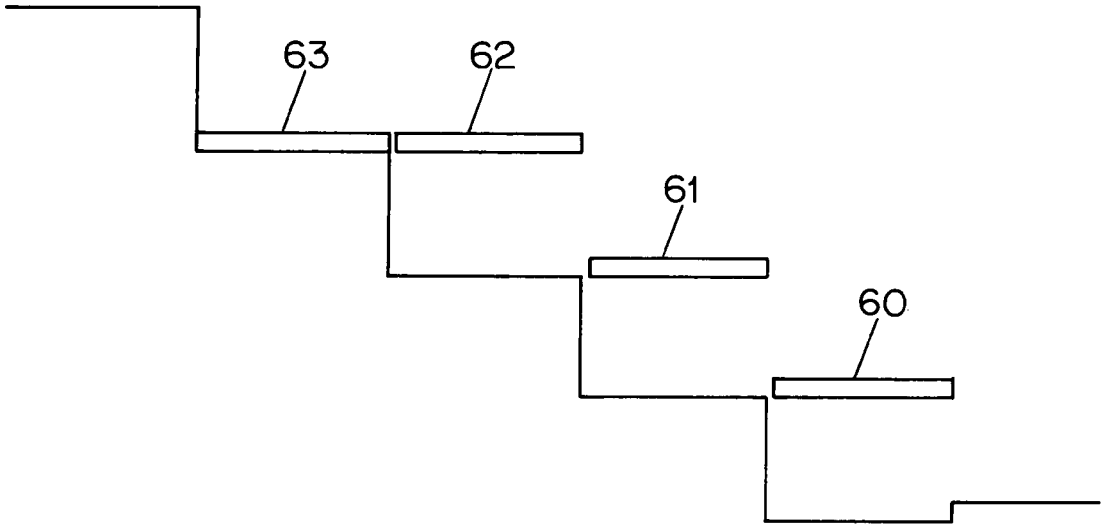

Turning now to FIG. 8, it may be seen that the tread 62 has been lifted by the tread rise distance, lifting the user with it. The user may then conveniently step forward onto tread 63.

Figure 9:
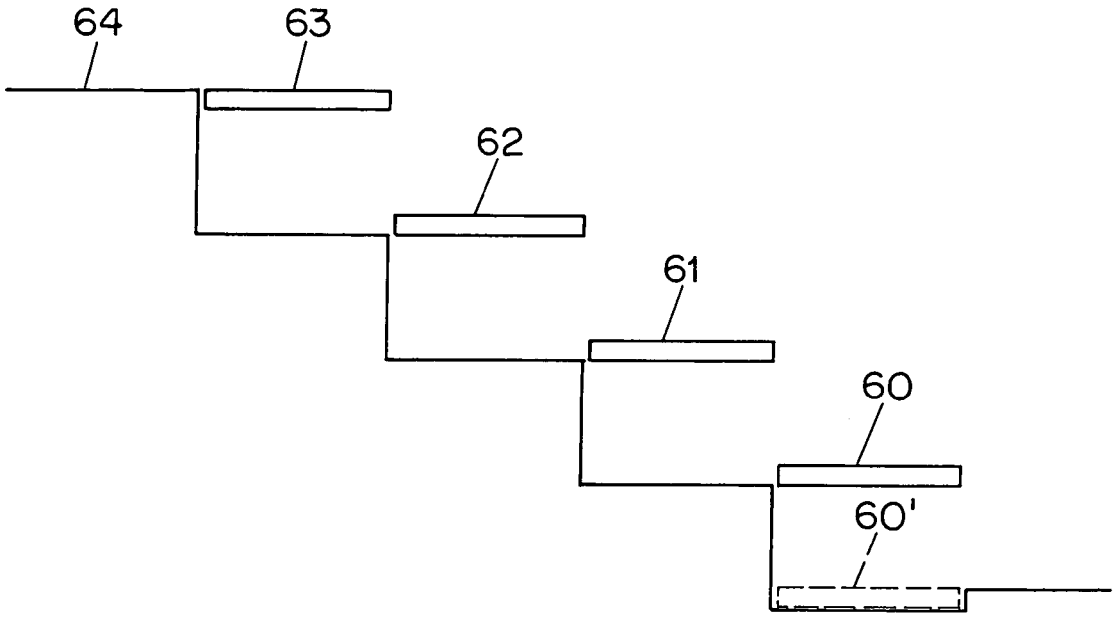

Turning now to FIG. 9, it may be seen that the tread 63 has been lifted by the tread rise distance, lifting the user with it. The user may then conveniently step forward onto floor 64. After the user has stepped off the staircase, the treads 63, 62, 61 and 60 may be lowered to their "rest" positions. Alternatively, a procedure may be followed in which the treads are lowered sooner. For example, by the time the user has reached tread 62 or 63, the tread 60 might be lowered to its "rest" position as shown in phantom at 60'.

The approach of lowering the treads 63, 62, 61 and 60 to their "rest" positions only after the user has exited the staircase has the advantage of simplicity and the above-mentioned potential advantage that a backwards fall for the user will present no greater risk than that on a prior-art staircase. It has the potential advantage that able-bodied persons could freely make use of the staircase even when it is in the process of lifting a user who is using the lift mechanism.

This approach has the potential drawback that a would-be second user, also desiring to ascend using the lofting capability, would have no choice but to wait until the first user had exited the staircase to be able to use the "lift" mechanism.

On the other hand, with a long staircase it might be preferable to lower a given tread much sooner, for example as soon as the user has progressed to a second or third tread above. This would permit a second user to commence ascending the staircase even before the first one had exited the staircase.

Descending the staircase, using the lift mechanism, is performed by reversing the steps just described. A user approaches the staircase as in FIG. 9, and tread 63 is lifted to match the height of floor 64. (In a simple case, the treads 62, 61 and 60 are likewise lifted to their upper positions.) The user steps forward to tread 63. Tread 63 is lowered as in FIG. 8 and the user steps forward to tread 62. Tread 62 is lowered as in FIG. 7 and the user steps forward to tread 61. Tread 61 is lowered as in FIG. 6 and the user steps forward to tread 60. Tread 60 is lowered as in FIG. 5 and the user steps forward onto the floor level 70.

Figure 10:
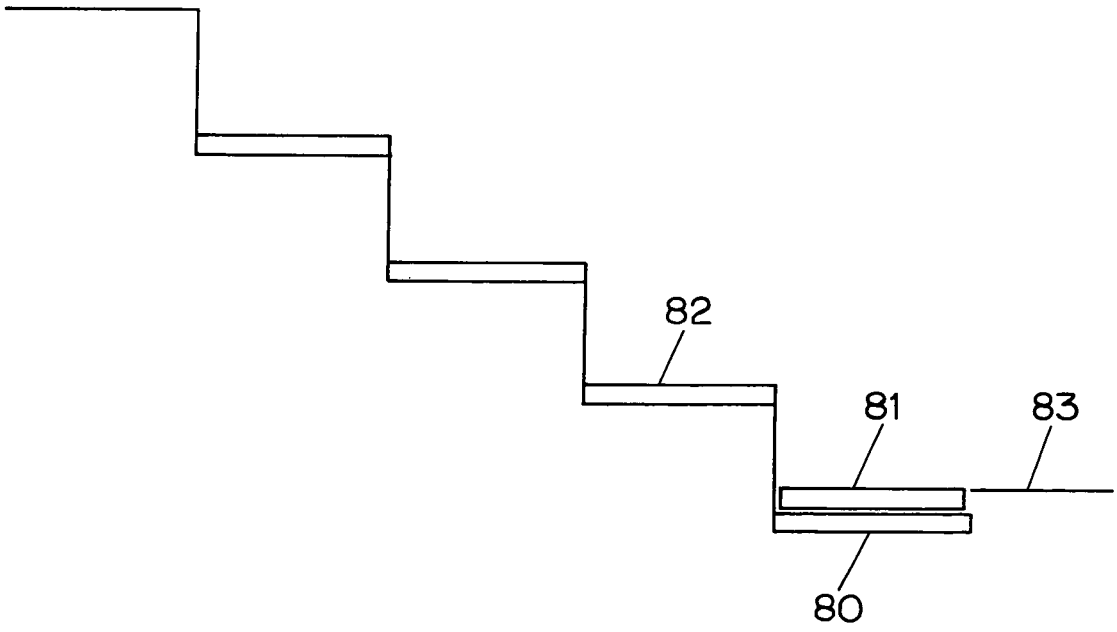
FIGS. 10–11 show a sequence of views for operation of a second embodiment of the invention.

In a more complicated case, the treads 62, 61 and 60 are lifted only slightly in advance of need. 10–11 show a sequence of views for operation of a second embodiment of the invention. In FIG. 10 it is assumed that a user who wishes to ascend (using the lifting mechanism) steps from floor 83 to carriage 81 which rests upon tread 80.

Figure 11:
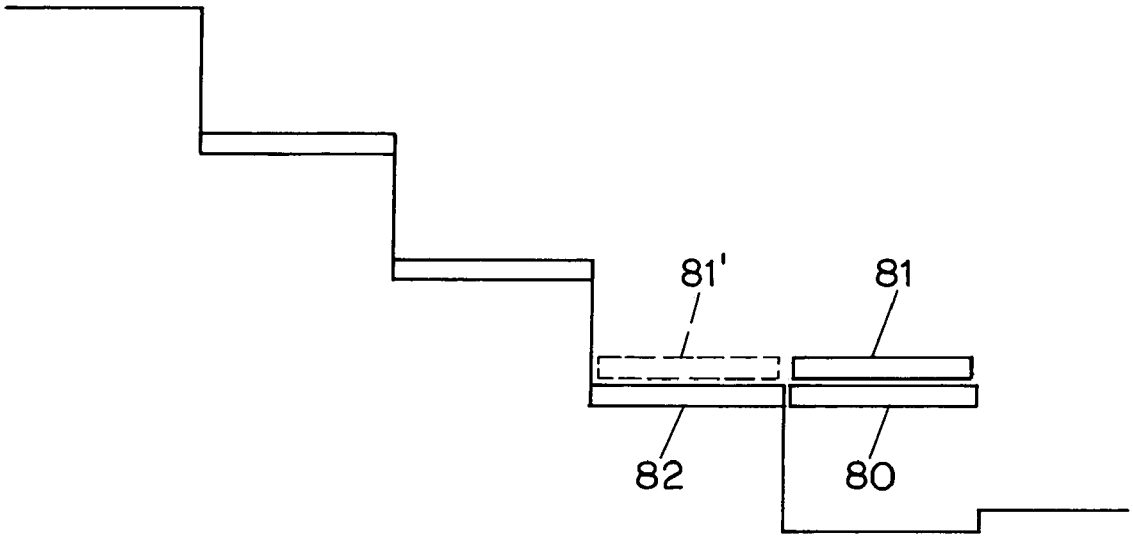

In FIG. 11 it may be seen that tread 80 has lifted by the tread riser distance, thus matching the height of tread 82. Carriage 81 then moves laterally (to the left in FIG. 11) by a mechanism omitted for clarity in FIG. 11 until it is in a position shown in phantom at 81' upon tread 82. This process is repeated until the user has reached the top of the staircase.

A similar process permits a user to descend the staircase, again using the carriage 81.

The "carriage" embodiment of FIGS. 10–11 has several advantages. For example if some large or bulky or heavy object needs to be moved, the user can simply place it on the carriage and stand next to it for the entirety of the upwards or downwards journey.

The "carriage" embodiment has potential drawbacks including the mechanical complexity of the carriage itself, as well as the problem that at any given time that the user wishes to ascend or descend, it may turn out that the carriage 81 is at the other end and must be called to the user. The "carriage" embodiment is most workable if each tread is identical to the next, and some combinations of non-identical treads may be unworkable with such a carriage.

It will be appreciated that while the system is depicted with a particular number of steps, the apparatus and method may be generalized to any number of steps. While the system is depicted with steps having a uniform rise and run, the apparatus and method may be generalized to non-uniform rise and non-uniform run. While the system is depicted with steps identical to each other in a straight path, the apparatus and method may be adapted to steps that are non-identical and that follow a non-straight path.

It is contemplated that the sequence of movements of the treads is preferably controlled by a microcontroller or microprocessor, omitted for clarity in FIGS. 5–11, but that other control mechanisms (deemed less preferable) could be employed, such as random digital logic or analog circuitry.

Preferably each tread mechanism has a strain gauge which senses whether or not the user is on a particular tread. In an upward journey, when the user steps forward (e.g. from tread 60 to 61 in FIG. 6) the system would know that the step has happened because the strain gauge of tread 61 would detect the weight of the user and the strain gauge of tread 60 would no longer detect that weight. This would signal the system to lift tread 61.

Heuristics may be employed to minimize the extent to which users would have to push buttons or otherwise specify the behavior of the staircase. In a household with several residents, the strain gauges would permit the system to know which member of the household is present, determined by weight. For users who prefer simply to walk up and down the stairs, the system could remain motionless with all steps at rest. For a user who (identified by weight) will prefer to use the lifting mechanism, the system could carry out its lifting steps as described aims described above are fulfilled by the staircase according to the invention. The mechanism is well-suited to helping people get from one level of a building to another. It is readily installed even in existing buildings, because it does not require substantial structural modifications. The tread lifting mechanisms, if provided by scissors jacks or by some other mechanism that is not too tall in its "rest" position, might simply be attached above the existing staircase treads. Nothing about the system (at least, the system embodiment lacking a carriage) requires the treads to be identical to each other, and nothing about the system requires the treads to be of any particular shape. Thus the retrofitting of the system according to the invention is able to proceed even if the staircase turns or goes around corners. Such a system, since it does not require structural modification of the building and may be removed later, is likely to be approved by a landlord or condominium association.

Importantly, depending on the lifting mechanism employed, the system according to the invention might not take up otherwise usable width of a staircase. Each liftable tread (depending on the lifting mechanism employed) is able to be as wide as the old tread it replaces Most importantly, the staircase according to the invention will not be visually intrusive, as compared for example with a chair track system.

Those skilled in the art will have no difficulty devising myriad obvious enhancements, improvements and variants of the embodiments described, without departing in any way from the invention, all of which are intended to be encompassed by the scope of the claims which follow.

The invention claimed is:

1. Staircase apparatus comprising a plurality of treads each movable vertically and not horizontally, each in a sequence relative to a next tread;

each tread movable between respective first and second positions, the second position higher than the first position, each tread comprising lifting means lifting said tread from said first position to said second position;

the respective second position for a tread matching the respective first position for the next tread.

2. The apparatus of claim 1 further comprising control means causing the treads to rise from respective first positions to respective second positions in the sequence.

3. The apparatus of claim 2 further characterized in that the control means causes the treads to descend from respective second positions to respective first positions in a reverse of the sequence.

4. Staircase apparatus comprising a plurality of treads each in a sequence relative to a next tread, and a carriage disposed in laterally movable relation to the treads;

each tread movable between respective first and second positions, the second position higher than the first position, each tread comprising lifting means lifting said tread from said first position to said second position;

the respective second position for a tread matching the respective first position for the next tread;

the carriage disposed, when a tread is in its second position and the next tread is in its first position, for lateral movement from one of the treads to the other.

5. The apparatus of claim 4 further comprising control means causing the treads to rise from respective first positions to respective second positions in the sequence.

6. The apparatus of claim 5 farther characterized in that the control means causes the treads to descend from respective second positions to respective first positions in a reverse of the sequence.

7. The apparatus of claim 5 further characterized in that the control means causes the carriage to proceed along the treads in the sequence.

8. A method of ascending a staircase, the staircase comprising a plurality of treads each movable vertically and not horizontally, each in a sequence relative to a next tread, each tread movable between respective first and second positions, the second position higher than the first position, the respective second position for a tread matching the respective first position for the next tread; the method comprising the steps of:

being on a tread;

lifting the tread from its first position to its second position;

stepping onto the next tread; and repeating the lifting and stepping steps until the staircase has been ascended.

9. A method of descending a staircase, the staircase comprising a plurality of treads each movable vertically and not horizontally, each in a sequence relative to a next tread, each tread movable between respective first and second positions, the second position higher than the first position, the respective second position for a tread matching the respective first position for the next tread; the method comprising the steps of:

being on a tread;

stepping onto the next tread;

lowering the next tread from its second position to its first position;

and repeating the stepping and lowering steps until the staircase has been descended.

10. A method performed with respect to a staircase apparatus comprising a plurality of treads each in a sequence relative to a next tread, and a carriage disposed in laterally movable relation to the treads, the carriage having a person thereupon; each tread movable between respective first and second positions, the second position higher than the first position, the respective second position for a tread matching the respective first position for the next tread; the carriage disposed, when a tread is in its second position and the next tread is in its first position, for lateral movement from one of the treads to the other, the carriage initially positioned on a tread in its first position, the method comprising the steps of:

lifting the tread from its first position to its second position;

moving the carriage laterally onto the next tread;

and repeating the lifting and moving steps until the carriage and the person have ascended the staircase.

11. A method performed with respect to a staircase apparatus comprising a plurality of treads each movable vertically and not horizontally, each in a sequence relative to a next tread, and a carriage disposed in laterally movable relation to the treads, the carriage having a person thereupon; each tread movable between respective first and second positions, the second position higher than the first position, the respective second position for a tread matching the respective first position for the next tread; the carriage disposed, when a tread is in its second position and the next tread is in its first position, for lateral movement from one of the treads to the other, the carriage initially positioned on a tread in its second position, the method comprising the steps of:

lowering the tread from its second position to its first position;

moving the carriage laterally onto the next tread;

and repeating the lowering and moving steps until the carriage and the person have descended the staircase.

12. Staircase apparatus comprising a plurality of treads each in a sequence relative to a next tread, and a carriage disposed in laterally movable relation to the treads;

each tread movable between respective first and second positions, the second position higher than the first position, each tread comprising lifting means lifting said tread from said first position to said second position;

the respective second position for a tread matching the respective first position for the next tread;

the carriage disposed, when a tread is in its second position and the next tread is in its first position, for lateral movement from one of the treads to the other.

13. The apparatus of claim 12 further comprising control means causing the treads to rise from respective first positions to respective second positions in the sequence.

14. The apparatus of claim 13 further characterized in that the control means causes the treads to descend from respective second positions to respective first positions in a reverse of the sequence.

15. The apparatus of claim 13 further characterized in that the control means causes the carriage to proceed along the treads in the sequence.

* * * * *